United States Patent [19]

Gruet

[11] Patent Number: 4,701,003

[45] Date of Patent: Oct. 20, 1987

[54] POUCH ASSEMBLY FOR COMPUTER CONTAINER

[75] Inventor: Victor B. Gruet, San Juan, Philippines

[73] Assignee: Computer Information System, Inc., Makati, Philippines

[21] Appl. No.: 918,450

[22] Filed: Oct. 14, 1986

[51] Int. Cl.[4] ..... H01R 13/00

[52] U.S. Cl. ..... 439/680

[58] Field of Search ..... 339/65, 66, 176 M, 198 R, 339/198 G

[56] References Cited

U.S. PATENT DOCUMENTS 4,350,401 9/1982 Allen et al. ..... 339/65

*Primary Examiner*—Joseph H. McGlynn

*Attorney, Agent, or Firm*—Kuhn and Muller

[57] ABSTRACT

An electrical connector which provides for multiple connections of hand held computers in one common line connection to a data station.

1 Claim, 4 Drawing Figures

POUCH ASSEMBLY FOR COMPUTER CONTAINER

Heretofore there is no known design which provides for the means to connect a hand held computer to one data station. The present invention not only facilitate such a means but also provides for multi connection of numerous hand held computers in one common line connection to the data station.

The present invention generally relates to a holder construction. More specifically, it relates to a pouch assembly adapted for holding and maintaining numerous computer containers appreciably in operating condition.

Likewise the present invention is specifically adapted to facilitate a common connection of numerous hand held computers to the data station.

Accordingly, an object of this invention is to provide a pouch assembly for computer container a tapered rectangular casing defining a lower section and an upper section interfitted on the upper portion of said lower section and extending therefrom.

Another object of this invention is to provide a computer container which is simple in structure, economical to manufacture and appreciably reliable.

These objects and other advantages of this invention will be fully comprehended upon a reading of the following detailed description when considered in relation to the accompanying drawings which form part of this disclosure.

Figure 1:
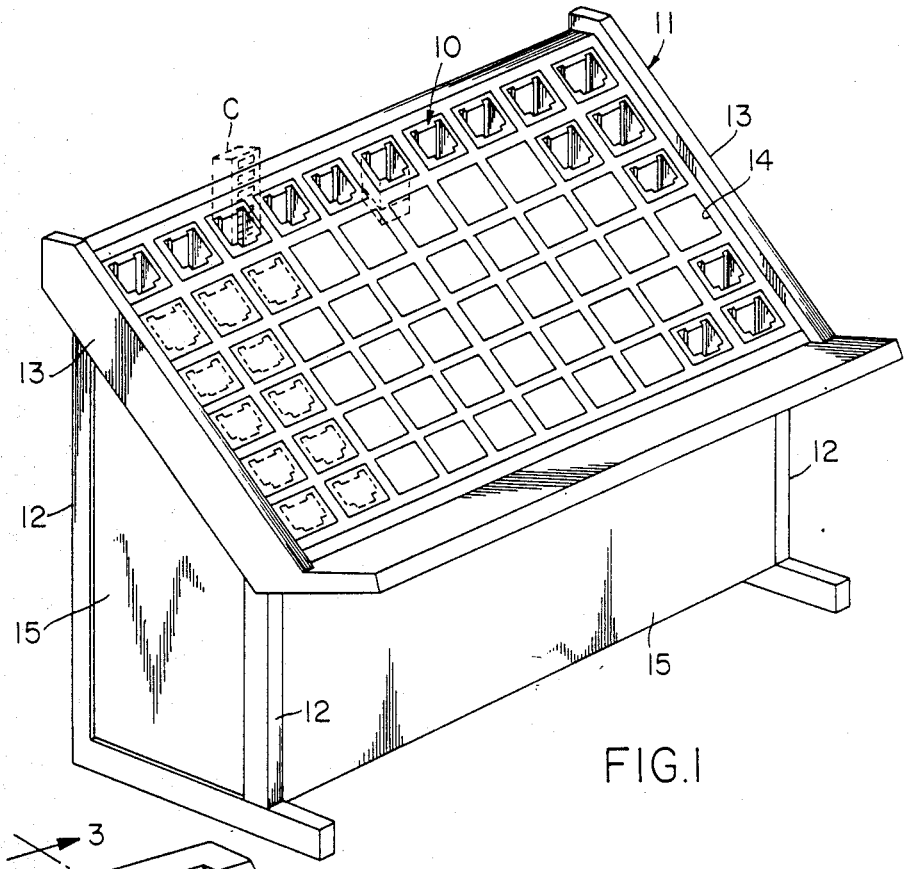
FIG. 1 is a perspective of a suitable stand for a computer container's pouch.

With reference now in detail to the drawings, there is shown in FIG. 1 several identical pouch generally designated as 10 for a computer container C that are arranged spacedly vertically and horizontally in an inclined manner to a stand 11. The stand 11 includes a supporting framework 12, a pair of oppositely parallel side rails 13 inclinedly secured on top of said framework 12, several pouch rack 14 disposed spacedly in-between said side rails 13, and peripheral side panels 15 enclosing said framework 12.

Figure 2:
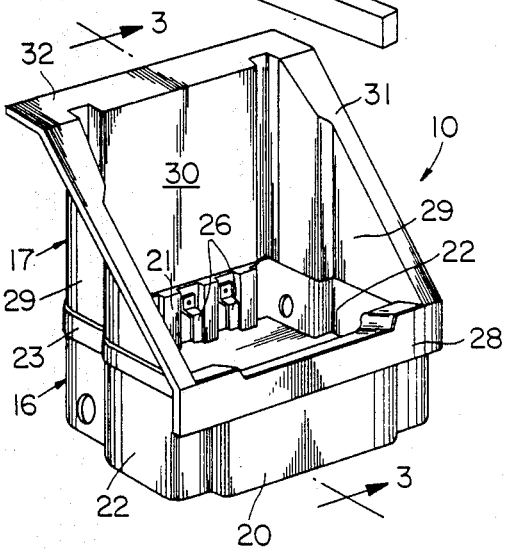
FIG. 2 is a perspective view of the pouch for computer container embodying the industrial design.
Figures 3, 4:
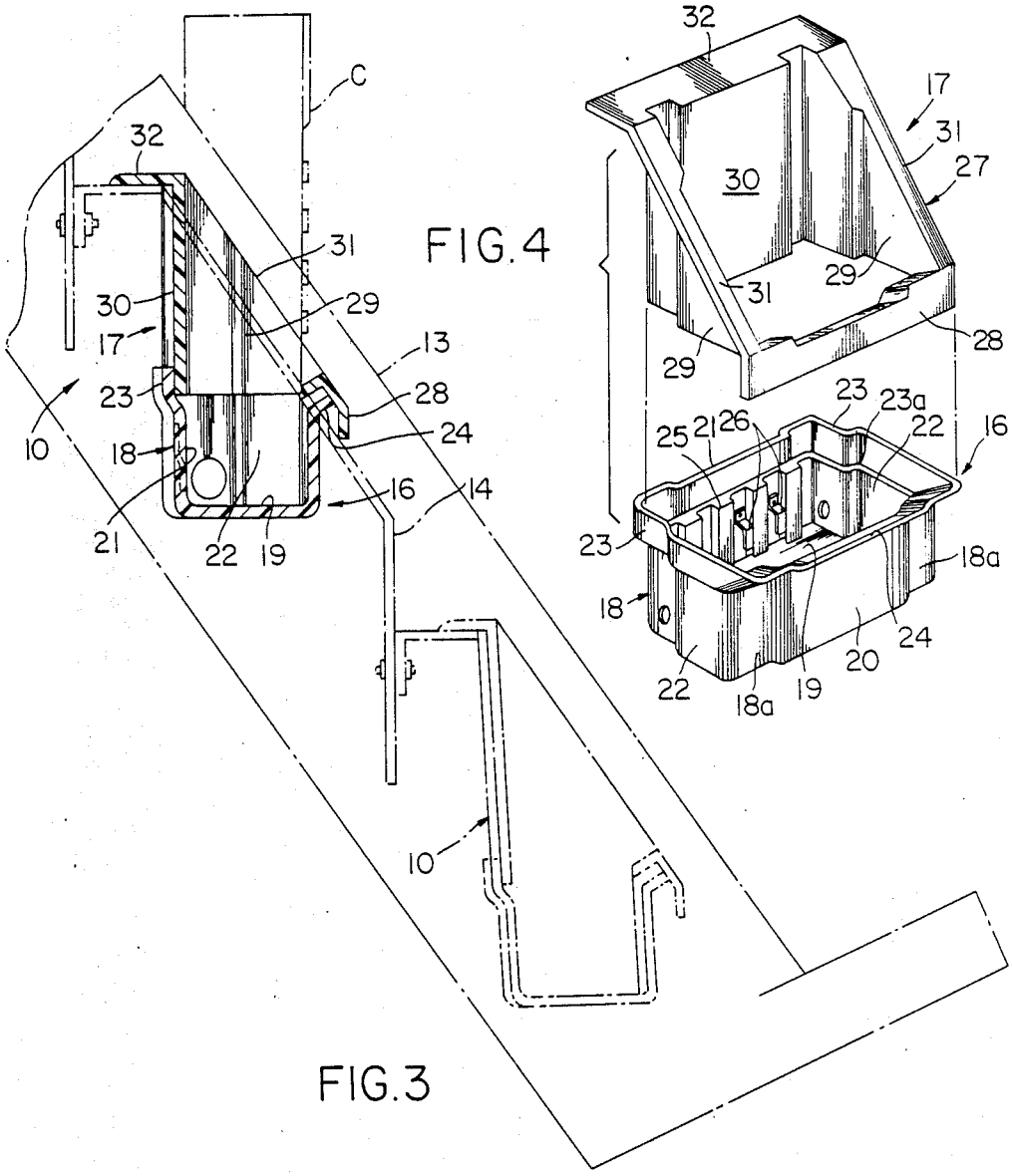
FIG. 3 is a longitudinal cross-sectional view taken along line 3—3 of FIG. 2.
FIG. 4 is an exploded view of the same pouch as shown in FIG. 2.

Disposed on each of said rack 14 is the pouch generally designated as 10. As best illustrated in FIGS. 2 to 4, each of these pouch 10 essentially comprises a tapered rectangular casing defining a lower section 16 and an upper section 17 having a lower portion interfitted within the upper portion of said lower section 16.

The lower section 16 consists of a hollow, substantially pre-shaped rectangular casing 18 having a bottom wall 19, a peripherally extending opposed front, rear and side walls 20, 21 and 22 extending upwardly from the bottom wall 19 and terminating at its upper end in a mouth. Said body being preshaped so as to provide bent sections 18a along the corner edges thereof. Substantially formed integrally at the upper portion adjoining rear and side walls 21 and 22 is an upstanding flange member 23 defining thereof a shoulder member 23a, and an inclined flange member 24 extending at its front wall. Formed at the lower of the rear wall 21 is a series of groove and ridges 25 through which a pair of contact plates 26 is secured.

Substantially dimensioned and preshaped to fit and be held fixed within said flanges 23 and 24 of the lower section 16 and uprightly extending therefrom is the upper section 17. This upper section 17 is a hollow rectangular and tapered front portion casing 27 having a downwardly bent front wall 28, opposed triangular-shaped side walls 29 and rear wall 30 dimensioned to be diametrically larger relative to said front wall 28, said walls defining upper and lower open end portion. Integrally formed on the upper terminal portion of said side and rear walls 29 and 30 and outwardly extending flange members 31 and 32, respectively. It may be noted that the flange members 31 is inclinedly directed with respect to the side walls 29 while flange 32 is substantially perpendicular with respect to the rear wall 30. This triangular structure of the side walls 29 is adapted for easy access of the computer container C to be maintained thereat.

I claim:

1. A pouch assembly for computer containers comprising a preshaped rectangular and tapered front portion casing defining a lower section and upper section interfitted with the upper portion of said lower section; said lower section having a bottom wall and a peripherally extending front, rear and side walls extending from said bottom wall and terminating at its upper end with an uptanding flange member of said side and rear walls and an inclined flange member at its front wall, and a pair of contact plates disposed within said rear wall; said upper section defines a hollow and tapered front portion casing having a bent front wall, opposed triangular-shaped side walls and rear walls, said rear wall being diametrically larger relative to said front wall, and an outwardly extending flange members integrally formed at the upper terminal portion of said rear and side walls, said walls defining upper and lower open end portion.

* * * * *